US006691433B2

(12) United States Patent
Liu

(10) Patent No.: US 6,691,433 B2
(45) Date of Patent: Feb. 17, 2004

(54) AUTOMATED TIGHTENING SHOE

(76) Inventor: Kun-Chung Liu, No. 5, Alley 9, Lane 212, San-Feng Rd., Hou-Li Hsiang, Taichun Hsien (TW)

( * ) Notice: Subject to any disclaimer, the term of this patent is extended or adjusted under 35 U.S.C. 154(b) by 56 days.

(21) Appl. No.: 10/186,693

(22) Filed: Jul. 2, 2002

(65) Prior Publication Data

US 2003/0150135 A1 Aug. 14, 2003

(51) Int. Cl.[7] ..... A43C 11/00; A43B 5/04

(52) U.S. Cl. ..... 36/50.1; 36/50.5; 24/685 K; 24/715 K

(58) Field of Search ..... 36/50.1, 50.5; 24/685 K, 695 K, 705 K, 715 K

(56) References Cited

U.S. PATENT DOCUMENTS 4,724,626 A * 2/1988 Baggio ..... 36/50.5
4,741,115 A * 5/1988 Pozzobon ..... 36/50.5
5,205,055 A * 4/1993 Harrell ..... 36/50.1
5,249,377 A * 10/1993 Walkhoff ..... 36/50.5
5,345,697 A * 9/1994 Quellais ..... 36/50.1
6,568,104 B2 * 5/2003 Liu ..... 36/50.1
6,598,322 B2 * 7/2003 Jacques et al. ..... 36/50.1

* cited by examiner

*Primary Examiner*—Anthony D. Stashick
(74) *Attorney, Agent, or Firm*—Foley & Lardner

(57) ABSTRACT

An automated tightening shoe includes a sole, an upper, a closure member, a tightening mechanism and a drive unit. The tightening mechanism includes a first fastener mounted on the upper, and a second fastener connected to the closure member and capable of removable engagement with the first fastener so as to retain releasably the closure member at a tightened state. The drive unit is mounted inside the sole, and is operable so as to pull the second fastener toward the first fastener in order to inter-engage the first and second fasteners, thereby resulting in automated tightening of the shoe.

13 Claims, 9 Drawing Sheets

AUTOMATED TIGHTENING SHOE

BACKGROUND OF THE INVENTION

1. Field of the Invention

The invention relates to a shoe, more particularly to a shoe with an automated tightening capability.

2. Description of the Related Art

In co-pending U.S. patent application Ser. No. 09/941,346, filed by the applicant on Aug. 28, 2001, there is disclosed an easy-to-wear shoe that includes a shoe body with first and second eyelet tabs. The second eyelet tab includes a front portion proximate to a vamp, a rear portion proximate to a top shoe opening, and an intermediate eyelet-free portion therebetween. Each of the front and rear portions of the second eyelet tab is provided with at least one eyelet. A first fastener has a mounting section mounted securely on the intermediate eyelet-free portion of the second eyelet tab, and a fastener engaging section provided on the mounting section. A second fastener has a shoe lace stringing section formed with at least one eyelet, and a fastener engaging section extending from the shoe lace stringing section and capable of removable engagement with the fastener engaging section of the first fastener. A shoe lace unit is strung through the eyelets of the first and second eyelet tabs and the second fastener.

It is desirable to improve the aforesaid shoe by incorporating an automated shoe tightening action therein to facilitate physically challenged users.

SUMMARY OF THE INVENTION

According to this invention, an automated tightening shoe comprises a sole, an upper, a closure member, a tightening mechanism and a drive unit.

The upper is connected to the sole, and has a toe portion and a heel portion. The upper is formed with an opening adjacent to the heel portion to permit slipping of a foot into the upper, and further has a tongue connected to the toe portion, and first and second closure tabs disposed to overlap opposite lateral sides of the tongue, respectively.

The closure member is provided on the upper, extends between the first and second closure tabs, and is connected to at least one of the first and second closure tabs. The closure member is movable from a loosening state, where the closure member allows limited movement of the first and second closure tabs away from each other, to a tightened state, where the closure member pulls the first and second closure tabs toward each other to tighten the shoe around the foot.

The tightening mechanism includes first and second fasteners. The first fastener has a mounting section mounted securely on the first closure tab, and a fastener engaging section provided on the mounting section. The second fastener is connected to the closure member, and has a fastener engaging portion capable of removable engagement with the fastener engaging section of the first fastener so as to retain releasably the closure member at the tightened state.

The drive unit is mounted inside the sole, and includes a housing, a spool mounted rotatably in the housing, a pull string and a motor unit. The pull string has a first anchored end connected to the spool, a second anchored end connected to the second fastener, and an intermediate string portion between the first and second anchored ends. The intermediate string portion extends outwardly of the sole and the upper to permit connection of the second anchored end to the second fastener. The motor unit is mounted in the housing, is coupled to the spool, and is operable so as to drive rotation of the spool in the housing to wind the pull string on the spool for pulling the second fastener toward the first fastener in order to engage the fastener engaging portion with the fastener engaging section, thereby resulting in automated tightening of the shoe.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
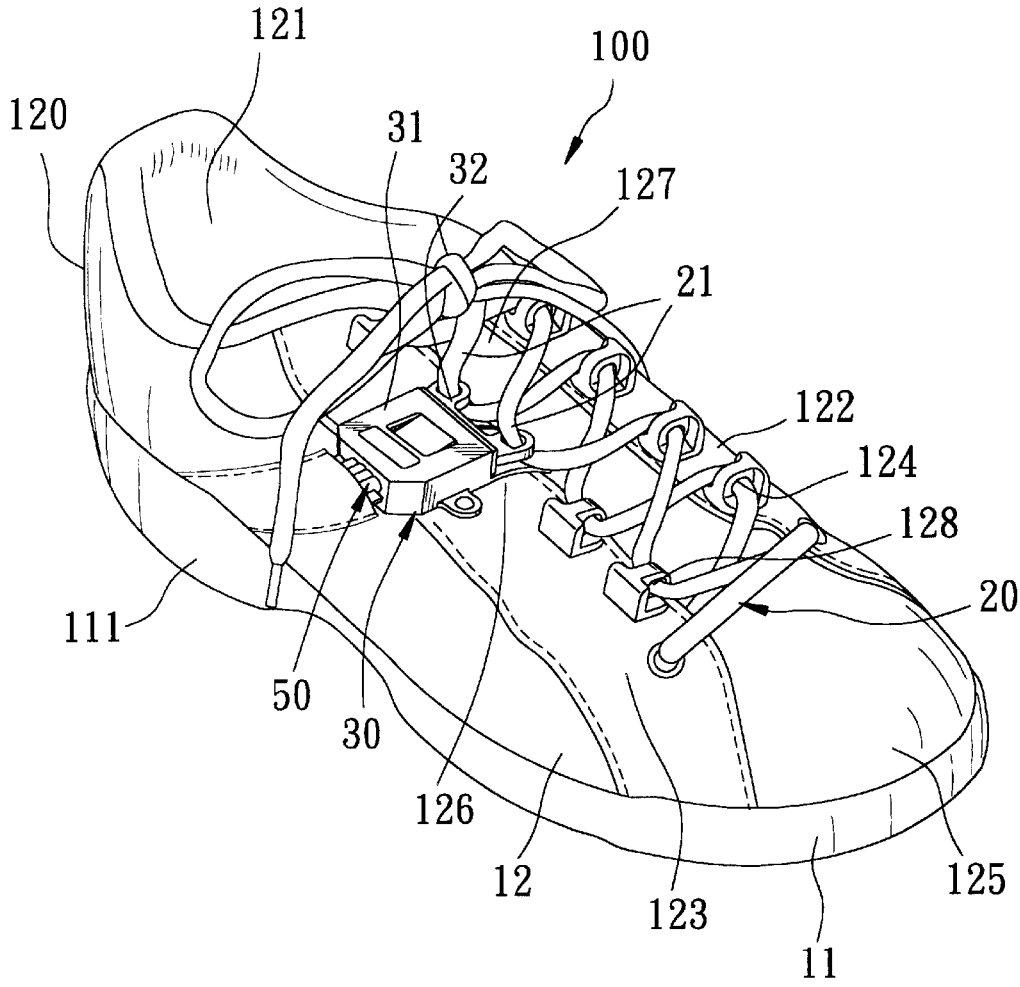
FIG. 1 is a perspective view showing a first preferred embodiment of an automated tightening shoe according to the present invention.
Figure 2:
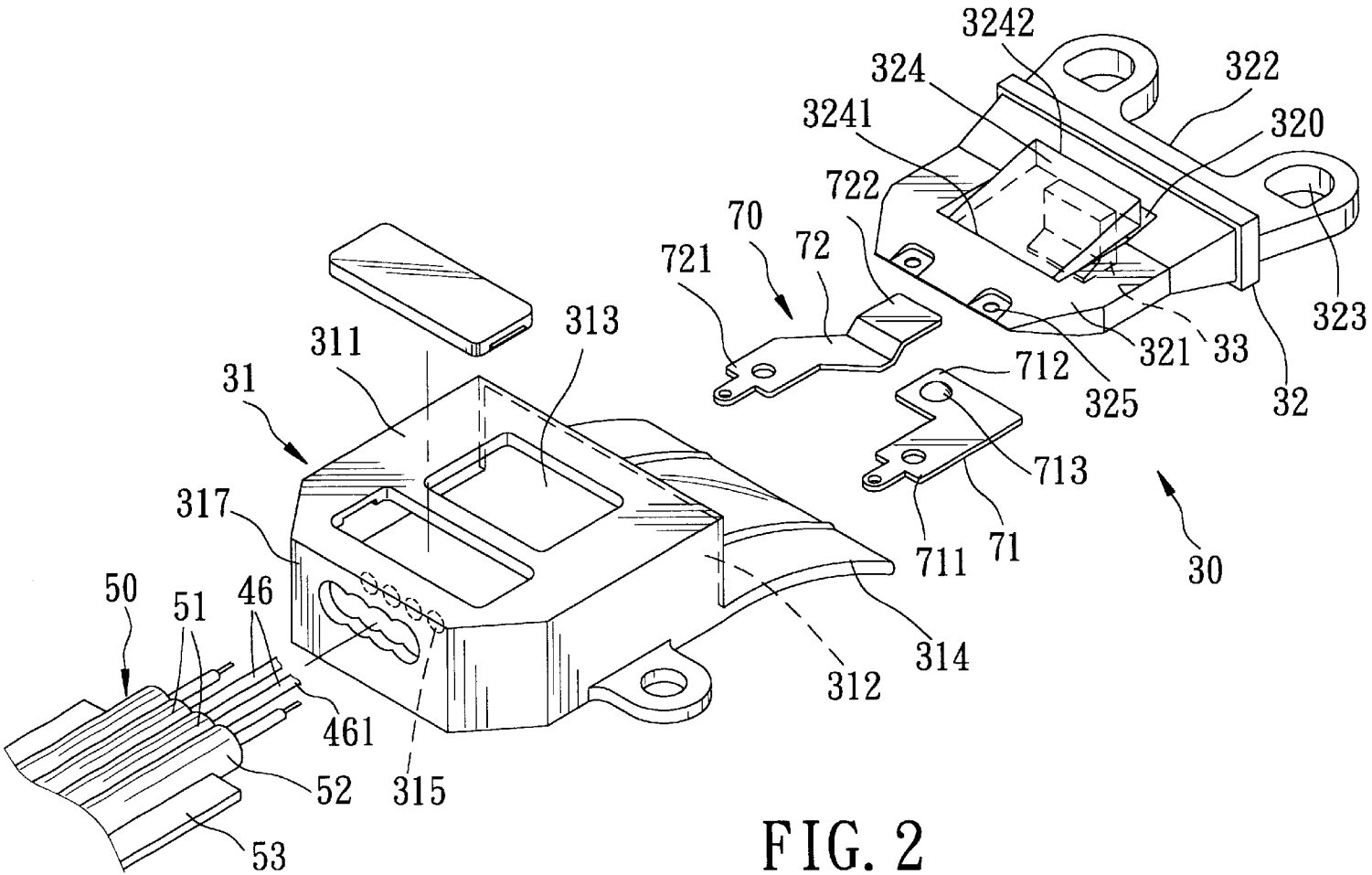
FIG. 2 is a fragmentary exploded perspective view to illustrate a tightening mechanism of the first preferred embodiment.
Figure 3:
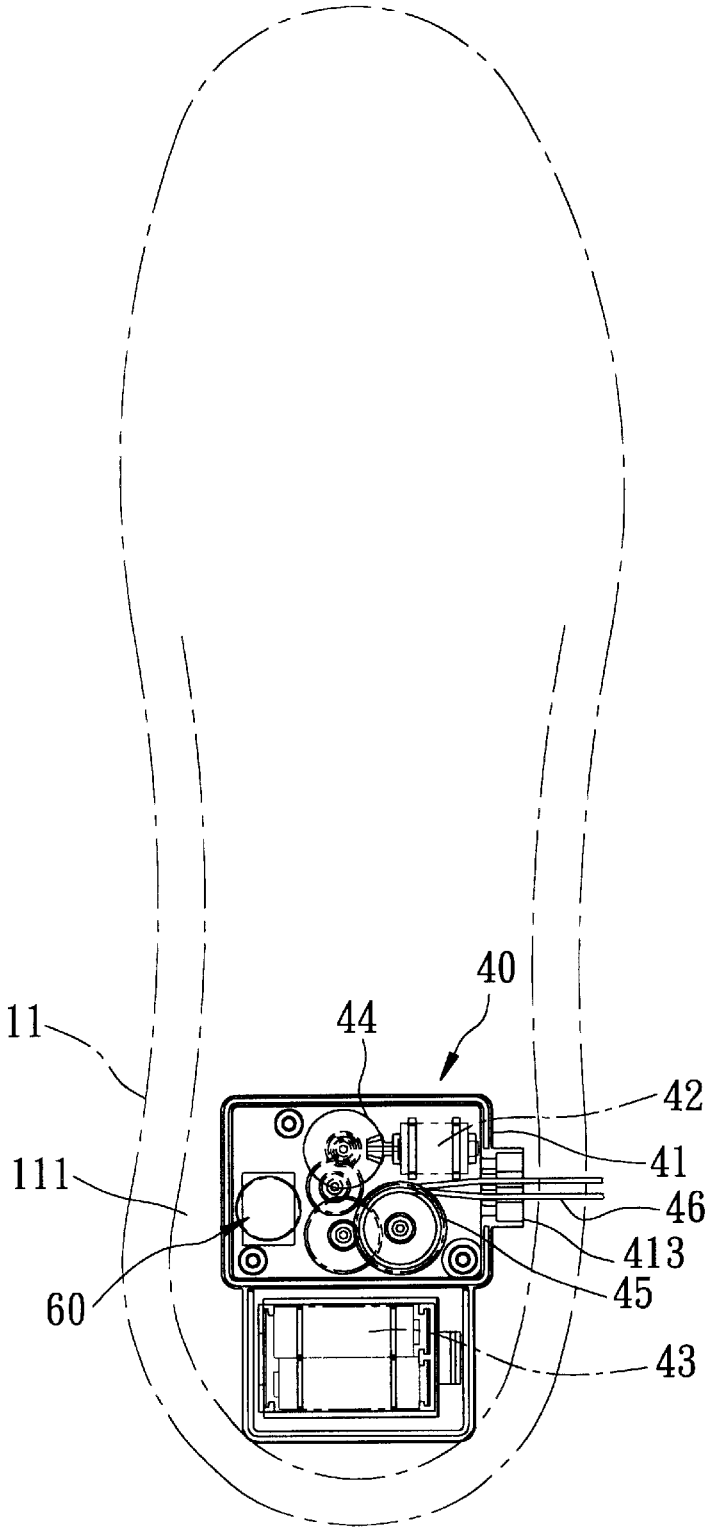
FIG. 3 is a schematic view to illustrate a drive unit of the first preferred embodiment.

Referring to FIGS. 1, 2 and 3, the first preferred embodiment of an automated tightening shoe 100 according to the present invention is shown to include a sole 11, an upper 12, a closure member 20, a tightening mechanism 30 and a drive unit 40.

The upper 12 is connected to the sole 11, and has a toe portion 125 and a heel portion 120. The upper 12 is formed with an upper opening 121 adjacent to the heel portion 120 to permit slipping of a foot into the upper 12, and has a tongue 127 connected to the toe portion 125, and first and second closure tabs 123, 122 disposed to overlap opposite lateral sides of the tongue 127, respectively. The first closure tab 123 has a first tab portion proximate to the toe portion 125, a second tab portion proximate to the opening 121, and an intermediate eyelet-free tab portion 126 between the first and second tab portions. The first tab portion is provided with two eyelets 128, whereas the second tab portion is provided with one eyelet 128. The second closure tab 122 is provided with a plurality of eyelets 124.

In this embodiment, the closure member 20 includes a shoe lace strung through the eyelets 128 of the first closure tab 123 and the eyelets 124 of the second closure tab 122. The closure member 20 is further formed with a pair of V-shape fastener connection portions 21 corresponding to the intermediate eyelet-free tab portion 126 of the first closure tab 123. The fastener connection portions 21 of the closure member 20 are movable from a loosening state, where the closure member 20 allows limited movement of the first and second closure tabs 123, 122 away from each other (see FIG. 8), to a tightened state, where the closure member 20 pulls the first and second closure tabs 123, 122 toward each other to tighten the shoe 100 around the foot (see FIG. 1).

The tightening mechanism 30 includes a first fastener 31 and a second fastener 32. The first fastener 31 has a mounting section 314 mounted securely on the intermediate eyelet-free tab portion 126 of the first closure tab 123, such as with the use of rivets (not shown), and a fastener engaging section 311 provided on the mounting section 314. The mounting section 314 and the fastener engaging section 311 of the first fastener 31 cooperate to impart the first fastener 311 with a tubular configuration. The first fastener 31 further has an open insert end 312 and a tube retaining end 317 opposite to the open insert end 312, and is formed with a radial fastener hole 313 and with a plurality of guide holes 315 in the tube retaining end 317. The second fastener 32 has a shoe lace stringing portion 322 and a fastener engaging portion 321 that is connected to the shoe lace stringing portion 322. The shoe lace stringing portion 322 is formed with a pair of eyelets 323 for connection with the fastener connection portions 21 of the closure member 20. The fastener engaging portion 321 is formed with a pair of string holes 325, and is further formed with a cutout 320. A resilient anchor member 324 is disposed in the cutout 320, and includes a wedge body having a tapered edge 3241 connected to the fastener engaging portion 321 at a periphery of the cutout 320, and an abutment edge 3242 opposite to the tapered edge 3241. When the fastener engaging portion 321 is inserted into the open insert end 312 of the first fastener 31, the resilient anchor member 324 extends into the radial fastener hole 313 in the first fastener 31 such that the abutment edge 3242 engages removably a periphery of the radial fastener hole 313. As such, the fastener engaging portion 321 is capable of removable engagement with the fastener engaging section 311 of the first fastener 31 so as to retain releasably the closure member 20 at the tightened state.

Figure 4:
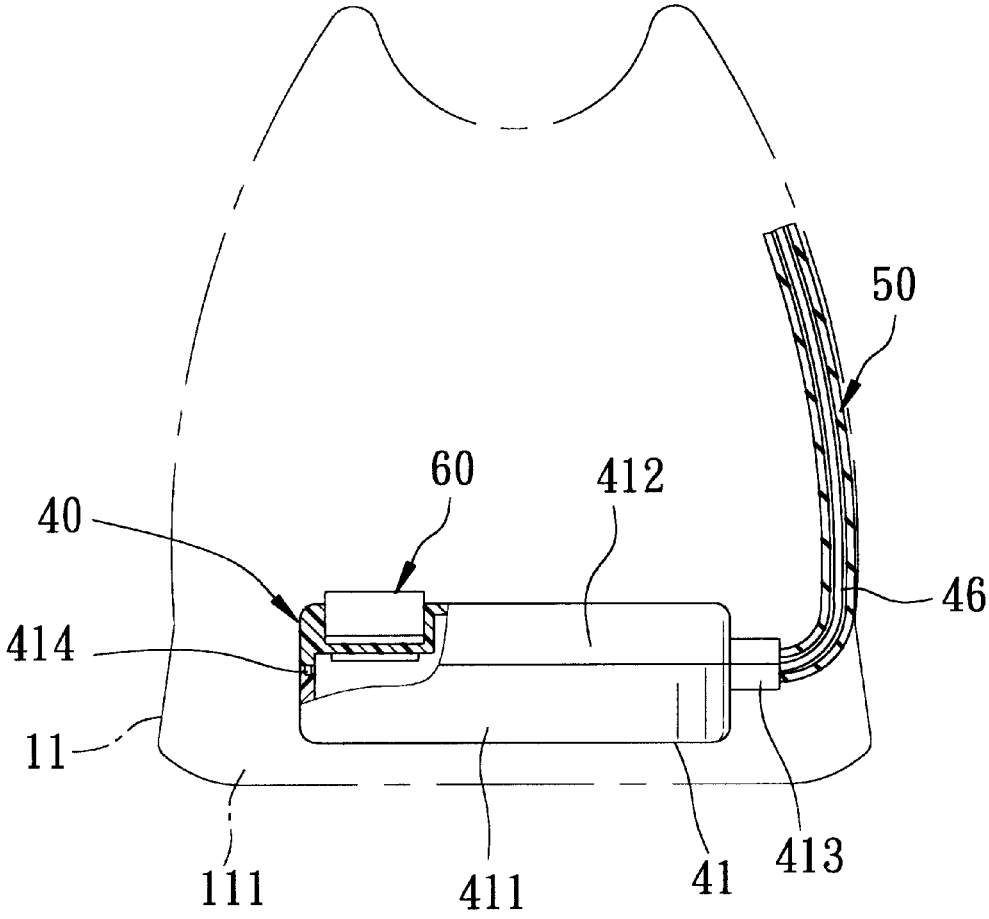
FIG. 4 is a partly sectional schematic side view of the drive unit.

Referring to FIGS. 3 and 4, the drive unit 40 is mounted in the heel portion 111 of the sole 11, and includes a housing 41, a spool 45 mounted rotatably in the housing 41, a pair of pull strings 46 and a motor unit. The housing 41 includes a bottom housing part 411 having a top opening, and a top housing part 412 having a bottom opening and mounted on the bottom housing part 411. A leak-shield ring 414 is disposed between the bottom housing part 411 and the top housing part 412. A tube guide 413 projects from one lateral side of the housing 41. Each of the pull strings 46 has a first anchored end connected to the spool 45, a second anchored end 461 (see FIG. 2) connected to a corresponding string hole 325 in the second fastener 32, and an intermediate string portion between the first and second anchored ends. The intermediate string portion of each pull string 46 extends through the tube guide 413, outwardly of the sole 11 and the upper 12, and passes through the corresponding guide hole 315 in the first fastener 31 to permit connection of the second anchored end 461 to the second fastener 32. The motor unit is mounted in the housing 41 and includes a motor 42, an electric power source 43, such as a battery unit, coupled to and supplying electric power to the motor 42, and a speed reduction gearing 44 for coupling the motor 42 to the spool 45. The motor unit is operable so as to drive rotation of the spool 45 in the housing 41 to wind the pull strings 46 on the spool 45 for pulling the second fastener 32 toward the first fastener 31 in order to engage the fastener engaging portion 321 with the fastener engaging section 311, thereby resulting in automated tightening of the shoe 100.

Preferably, the shoe 100 further includes a guide tube unit 50 provided on the upper 12 and extending between the tube guide 413 on the housing 41 of the drive unit 40 and the tube retaining end 317 (see FIG. 2) of the first fastener 31. The guide tube unit 50 permits extension of the intermediate string portions of the pull strings 46 therethrough, and includes a pair of pull string tubes 51 for the pull strings 46, and a pair of switch line tubes 52. The guide tube unit 50 is provided with flaps 53 for securing the tubes 51, 52 to the upper 12, such as by sewing.

The drive unit 40 further includes a control switch 60 mounted on the sole 11 and coupled to the motor unit. Preferably, the control switch 60 is mounted on the housing 41 of the drive unit 40, which in turn is mounted in the heel portion 111 of the sole 11. The control switch 60 is capable of activating the motor unit for driving the spool 45 to wind the pull strings 46 when pressure is applied on the control switch 60 by the foot that is slipped into the upper 12.

Figure 5:
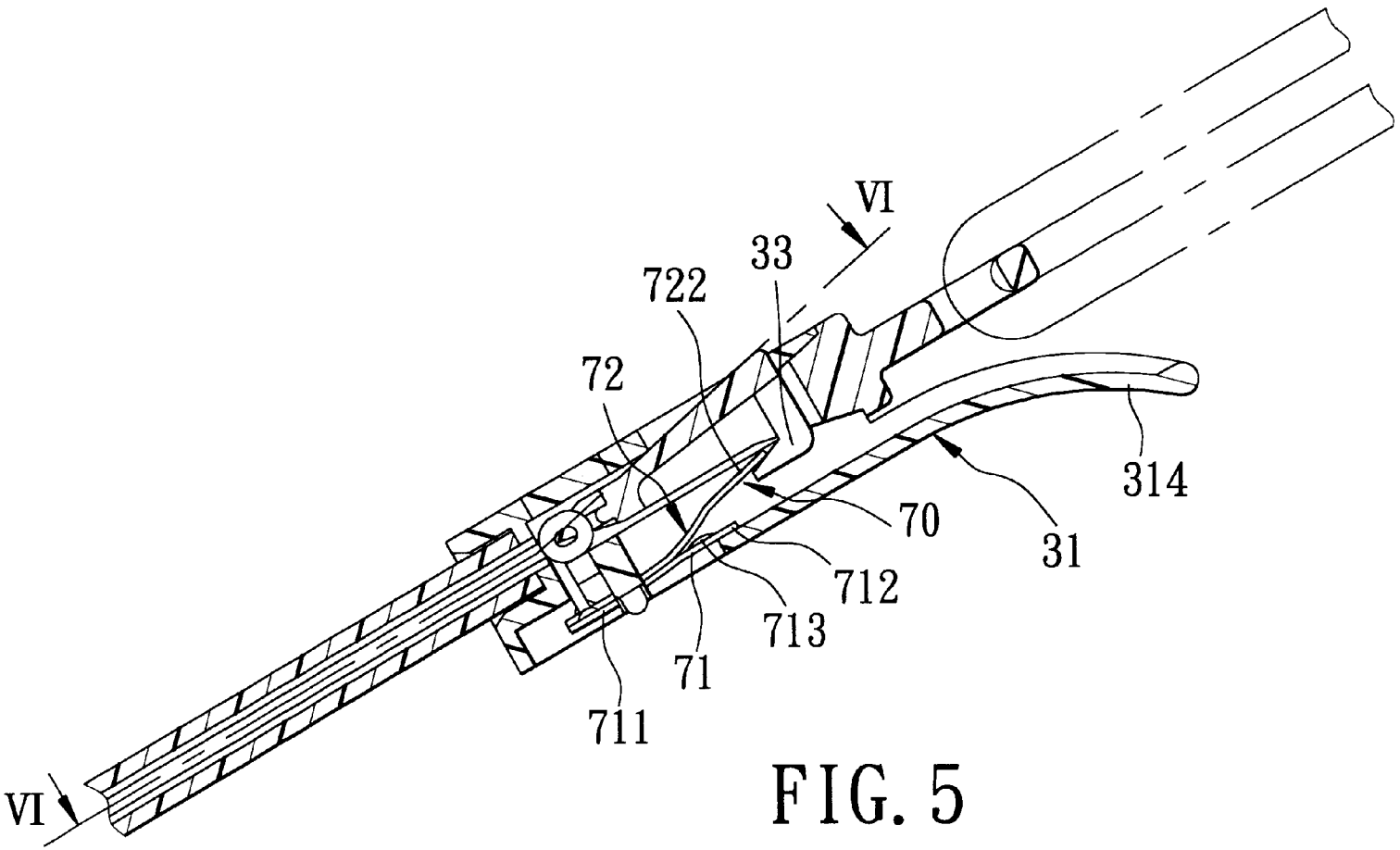
FIG. 5 is a fragmentary sectional view of the first preferred embodiment to illustrate engagement between first and second fasteners for retaining a closure member in a tightened state.
Figure 6:
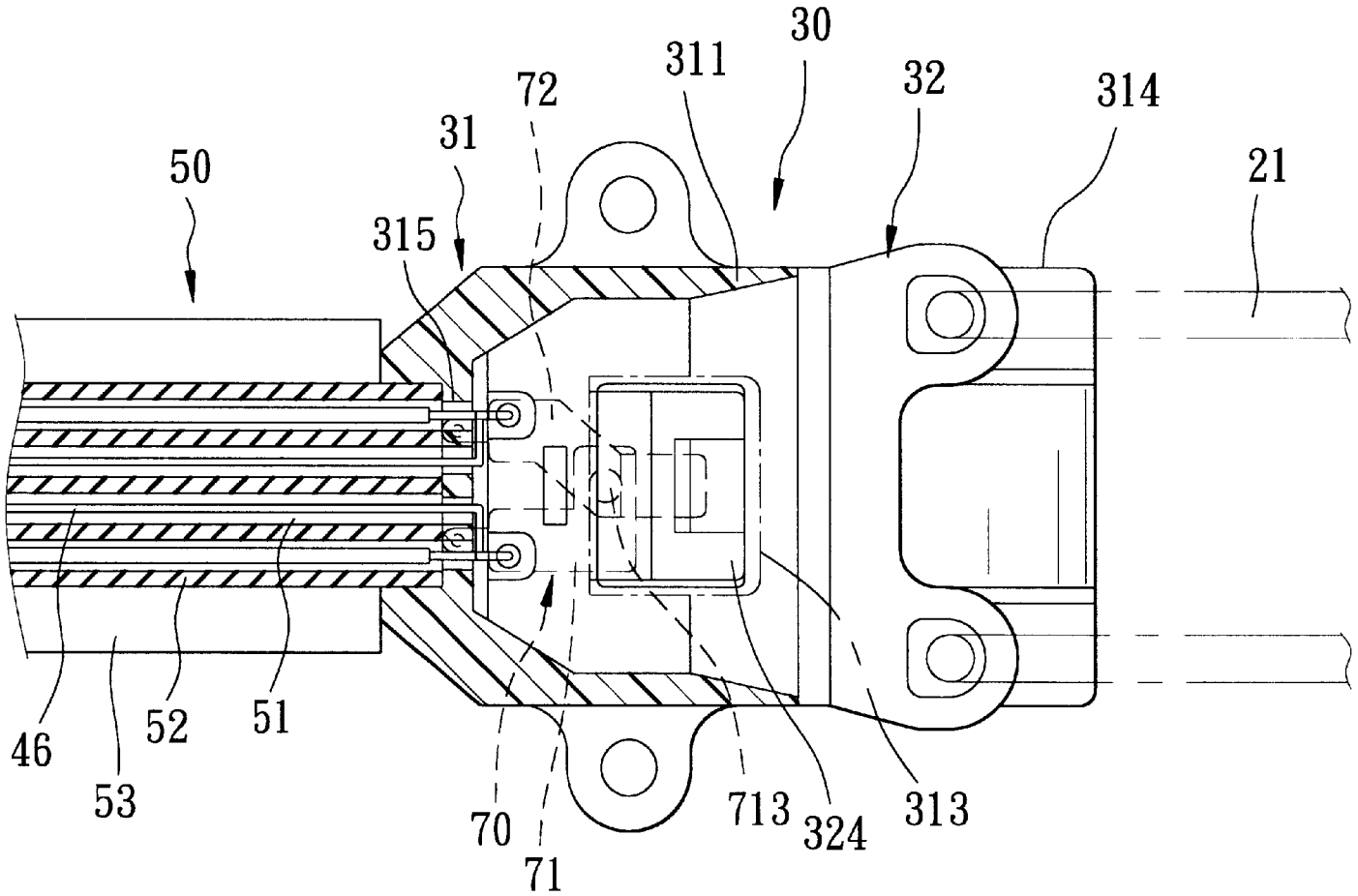
FIG. 6 is a sectional view taken along line VI—VI in FIG. 5.

Referring to FIGS. 5 and 6, the drive unit 40 further includes a cut-off switch 70 provided in the first fastener 31 and coupled to the motor unit. The cut-off switch 70 is capable of deactivating the motor unit when the fastener engaging portion 321 engages the fastener engaging section 311. In this embodiment, the cut-off switch 70 includes a stationary contact 71 and a resilient contact 72 for contacting the stationary contact 71. The second fastener 32 is formed with an insulator spacer 33 to space apart the resilient contact 72 from the stationary contact 71 when the fastener engaging portion 321 of the second fastener 32 is inserted into the first fastener 31. In this embodiment, the stationary contact 71 has a first engaging end portion 711 and an opposite first contact portion 712. The first engaging end portion 711 is retained on top of the mounting portion 314 of the first fastener 31, and is connected to a switch line originating from the drive unit 40 and extending through one of the switch line tubes 52. The first contact portion 712 lies flat on the mounting portion 314, and is formed with a contact point 713. The resilient contact 72 has a second engaging end portion 721 and an opposite second contact portion 722. The second engaging end portion 721 is also retained on top of the mounting portion 314 of the first fastener 31, and is connected to another switch line originating from the drive unit 40 and extending through the other one of the switch line tubes 52. The second contact portion 722 extends above the first contact portion 712 and is biased toward the contact point 713. The spacer 33 is in the form of an L-shaped hook that extends from the resilient anchor member 324, and exerts an uplifting force to space the second contact portion 722 apart from the contact point 713 when the resilient anchor member 324 is inserted into the first fastener 31. The control switch 60 and the cut-off switch 70 are connected in series between the motor 42 and the power source 43 of the motor unit.

Referring to FIGS. 1, 3 and 6, when a foot is slipped into the upper 12 via the upper opening 121, and pressure is applied on the control switch 60 by the heel, connection between the motor 42 and the power source 43 is enabled, thereby permitting the motor 42 to drive the spool 45 to rotate in the housing 41 via the speed reduction gearing 44. As a result, the pull strings 46 are gradually wound on the spool 45 such that the second fastener 32 that is connected to the second anchored ends 461 of the pull strings 46 will be pulled toward the first fastener 31. The fastener engaging portion 321 of the second fastener 32 eventually extends into the first fastener 31, and the resilient anchor member 324 engages the periphery of the radial fastener hole 313 in the first fastener 31. At this time, the spacer 33 spaces apart the second contact portion 722 of the resilient contact 72 from the contact point 713 of the stationary contact 71, as shown in FIG. 5. Thus, connection between the motor 42 and the power source 43 is disrupted to stop operation of the motor 42. The shoe 100 is now in the tightened state.

Figure 7:
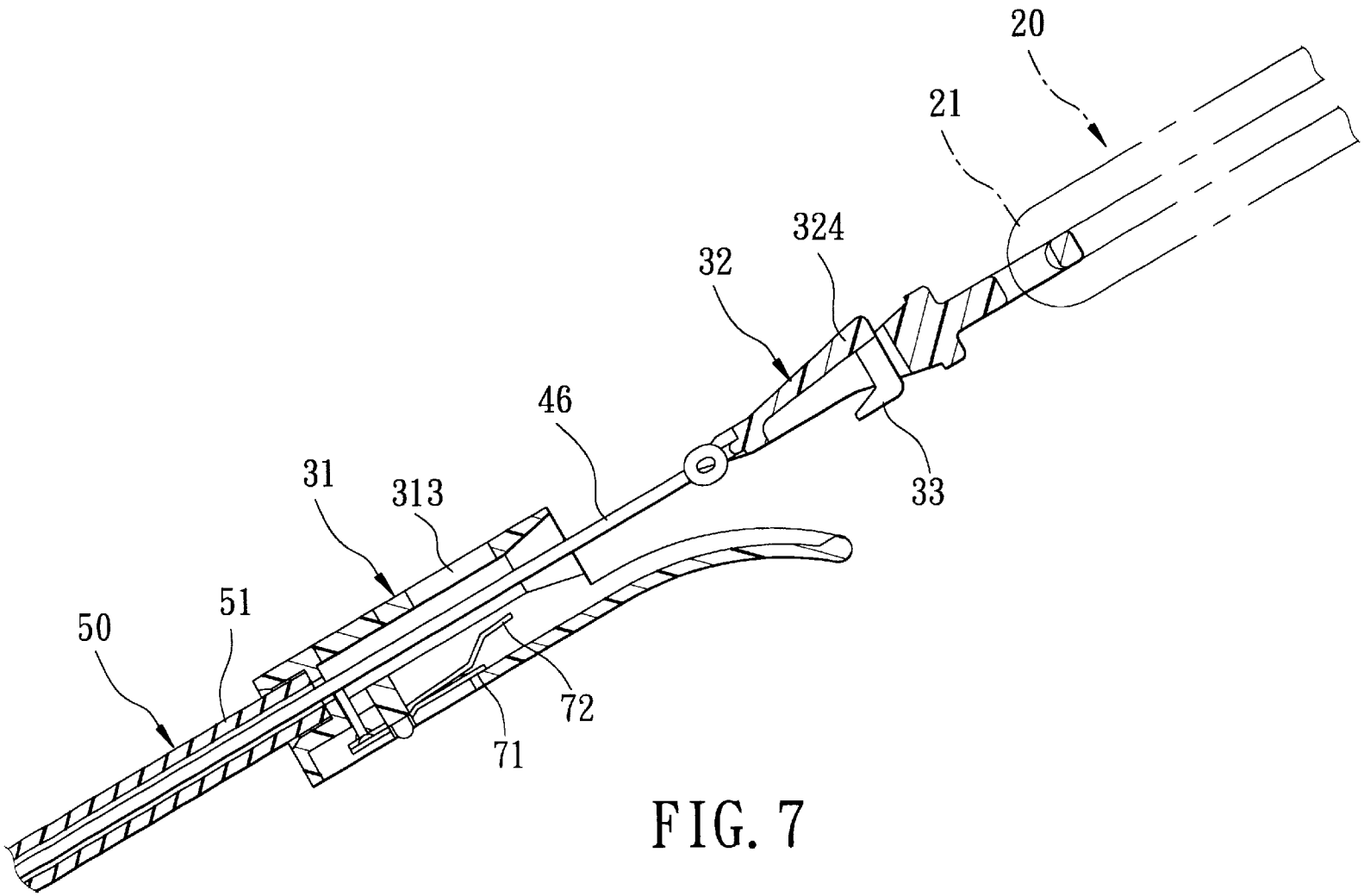
FIG. 7 is a view similar to FIG. 5, but showing the first and second fasteners in a disengaged state.
Figure 8:
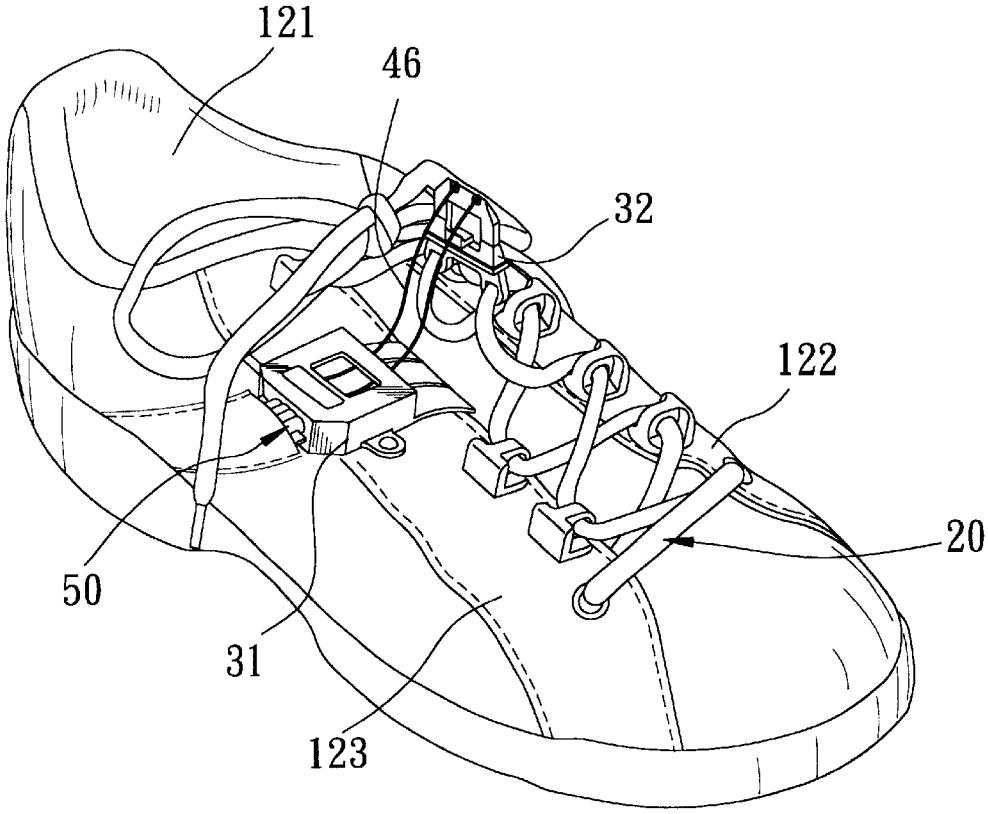
FIG. 8 is a perspective view of the first preferred embodiment to illustrate the closure member in a loosened state.

Referring to FIGS. 7 and 8, when it is desired to take off the shoe 100, the resilient anchor member 324 is operated to disengage the same from the periphery of the radial fastener hole 313 in the first fastener 31. Then, by virtue of uplifting force of the shoe-removal action, the first closure tab 123 and the second closure tab 122 will be moved away from each other, and the closure member 20 will pull the second fastener 32 out of the first fastener 31. The shoe 100 is now in the loosening state.

Figure 9:
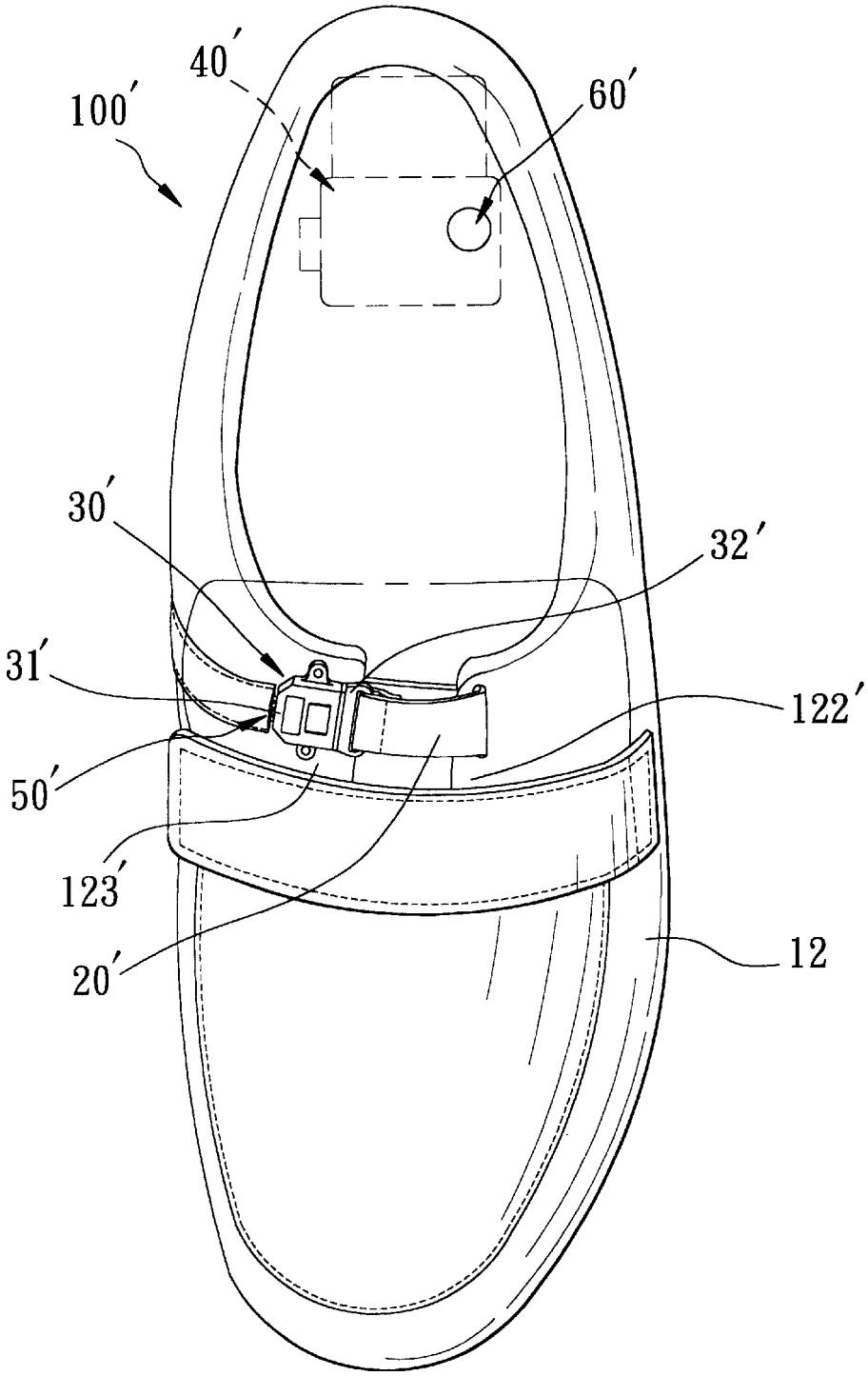
FIG. 9 is a schematic view of a second preferred embodiment of an automated tightening shoe according to the present invention.

Referring to FIG. 9, a second preferred embodiment of an automated tightening shoe 100' according to the present invention is shown to similarly include an upper 12' connected to a sole and provided with first and second closure tabs 123', 122', a closure member 20', a tightening mechanism 30' including first and second fasteners 31', 32', a drive unit 40', a guide tube unit 50', a control switch 60' and a cut-off switch (not shown). Unlike the embodiment described beforehand, the closure member 20' includes a flexible strap having one end connected securely to the second closure tab 122' and an opposite end connected to the second fastener 32'. The shoe wearing and removal operations are the same as those for the previous embodiment.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An automated tightening shoe comprising:

a sole;

an upper connected to said sole and having a toe portion and a heel portion, said upper being formed with an opening adjacent to said heel portion to permit slipping of a foot into said upper, said upper further having a tongue connected to said toe portion, and first and second closure tabs disposed to overlap opposite lateral sides of said tongue, respectively;

a closure member provided on said upper, extending between said first and second closure tabs, and connected to at least one of said first and second closure tabs, said closure member being movable from a loosening state, where said closure member allows limited movement of said first and second closure tabs away from each other, to a tightened state, where said closure member pulls said first and second closure tabs toward each other to tighten said shoe around the foot;

a tightening mechanism including a first fastener having a mounting section mounted securely on said first closure tab, and a fastener engaging section provided on said mounting section, and a second fastener connected to said closure member, and having a fastener engaging portion capable of removable engagement with said fastener engaging section of said first fastener so as to retain releasably said closure member at the tightened state; and a drive unit mounted inside said sole, and including a housing, a spool mounted rotatably in said housing, a pull string having a first anchored end connected to said spool, a second anchored end connected to said second fastener, and an intermediate string portion between said first and second anchored ends, said intermediate string portion extending outwardly of said sole and said upper to permit connection of said second anchored end to said second fastener, and a motor unit mounted in said housing and coupled to said spool, said motor unit being operable so as to drive rotation of said spool in said housing to wind said pull string on said spool for pulling said second fastener toward said first fastener in order to engage said fastener engaging portion with said fastener engaging section, thereby resulting in automated tightening of said shoe.

2. The automated tightening shoe as claimed in claim 1, wherein said mounting section and said fastener engaging section of said first fastener cooperate to impart said first fastener with a tubular configuration, said first fastener having an open insert end and being formed with a radial fastener hole, said fastener engaging portion of said second fastener being formed with a resilient anchor member that is inserted into said open insert end for engaging removably said fastener hole.

3. The automated tightening shoe as claimed in claim 2, wherein said fastener engaging portion of said second fastener is formed with a cutout, said resilient anchor member being disposed in said cutout and including a wedge body having a tapered edge connected to said fastener engaging portion at a periphery of said cutout, and an abutment edge opposite to said tapered edge to engage a periphery of said radial fastener hole in said first fastener.

4. The automated tightening shoe as claimed in claim 1, wherein said drive unit further includes a control switch mounted on said sole and coupled to said motor unit, said control switch being capable of activating said motor unit for driving said spool to wind said pull string when pressure is applied on said control switch by the foot that is slipped into said upper.

5. The automated tightening shoe as claimed in claim 4, wherein said control switch is mounted at a heel portion of said sole.

6. The automated tightening shoe as claimed in claim 5, wherein said housing of said drive unit is mounted in the heel portion of said sole, and said control switch is mounted on said housing.

7. The automated tightening shoe as claimed in claim 1, wherein said drive unit further includes a cut-off switch provided on said first fastener and coupled to said motor unit, said cut-off switch being capable of deactivating said motor unit when said fastener engaging portion engages said fastener engaging section.

8. The automated tightening shoe as claimed in claim 2, wherein said drive unit further includes a cut-off switch provided in said first fastener and coupled to said motor unit, said cut-off switch being capable of deactivating said motor unit when said fastener engaging portion engages said fastener engaging section.

9. The automated tightening shoe as claimed in claim 8, wherein said cut-off switch includes a stationary contact and a resilient contact for contacting said stationary contact, said second fastener being formed with an insulator spacer to space apart said resilient contact from said stationary contact when said fastener engaging portion of said second fastener is inserted into said first fastener.

10. The automated tightening shoe as claimed in claim 1, wherein said motor unit includes a motor, an electric power source coupled to and supplying electric power to said motor, and a speed reduction gearing for coupling said motor to said spool.

11. The automated tightening shoe as claimed in claim 1, wherein said upper is further provided with a guide tube unit that permits extension of said intermediate string portion therethrough.

12. The automated tightening shoe as claimed in claim 1, wherein:

said first closure tab has a first tab portion proximate to said toe portion, a second tab portion proximate to said opening, and an intermediate eyelet-free tab portion between said first and second tab portions, said first and second tab portions being provided with at least one eyelet;

said second closure tab being provided with a plurality of eyelets;

said first fastener being mounted securely on said intermediate eyelet-free tab portion of said first closure tab;

said second fastener further having a shoe lace stringing portion connected to said fastener engaging portion and formed with at least one eyelet;

said closure member including a shoe lace strung through said eyelets of said first closure tab, said eyelets of said second closure tab, and said at least one eyelet of said shoe lace stringing portion of said second fastener.

13. The automated tightening shoe as claimed in claim 1, wherein said closure member includes a flexible strap having one end connected securely to said second closure tab and an opposite end connected to said second fastener.

* * * * *